US007627960B2

(12) United States Patent
Beyerle et al.

(10) Patent No.: US 7,627,960 B2
(45) Date of Patent: Dec. 8, 2009

(54) CLOTHES DRYER DRUM PROJECTIONS

(75) Inventors: Michael Thomas Beyerle, Pewee Valley, KY (US); David Duane Warmuth, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/610,014

(22) Filed: Jun. 30, 2003

(65) Prior Publication Data

US 2004/0261288 A1 Dec. 30, 2004

(51) Int. Cl.
*F26B 11/02* (2006.01)

(52) U.S. Cl. ..... 34/602; 34/603; 8/158; 68/58; 366/154.1

(58) Field of Classification Search ..... 34/599, 34/602, 603, 606, 607; 8/158; 68/20, 58; 366/154.1
See application file for complete search history.

(56) References Cited

U.S. PATENT DOCUMENTS 1,169,782 A * 2/1916 Eden ..... 68/142
1,655,514 A * 1/1928 Seifert ..... 34/601
1,792,137 A * 2/1931 Bethke ..... 366/225
1,849,283 A * 3/1932 Crane ..... 68/12.19
1,930,831 A * 10/1933 Webb ..... 324/695
2,043,332 A * 6/1936 Patterson ..... 34/143
2,048,743 A * 7/1936 Huebsch et al. ..... 34/599
2,262,186 A * 11/1941 Lindberg ..... 34/607
2,275,600 A * 3/1942 Arnold ..... 366/229
2,347,190 A * 4/1944 Geldhof et al. ..... 68/12.01
2,350,108 A * 5/1944 Geldhof et al. ..... 68/12.01
2,385,223 A * 9/1945 Moore ..... 34/599
2,453,727 A * 11/1948 Rasmussen ..... 210/365
2,523,305 A * 9/1950 Johnson ..... 68/53
2,540,955 A * 2/1951 Moore ..... 34/605
2,547,238 A * 4/1951 Tremblay ..... 34/603
2,574,985 A * 11/1951 Russell ..... 68/139
2,577,104 A * 12/1951 Butler ..... 34/572
2,608,769 A * 9/1952 O'Neil ..... 34/131
2,617,203 A * 11/1952 Murray ..... 34/82
2,619,736 A * 12/1952 Geldhof ..... 34/131
2,619,737 A * 12/1952 Geldhof et al. ..... 34/604
2,648,142 A * 8/1953 Shapter ..... 34/82
2,652,708 A * 9/1953 Rimsha et al. ..... 68/20
2,654,160 A * 10/1953 Peterson ..... 34/543
2,665,500 A * 1/1954 Zehrbach ..... 34/82
2,681,513 A * 6/1954 Fowler ..... 34/82
2,686,372 A * 8/1954 Graham ..... 34/75
2,686,978 A * 8/1954 Herbster ..... 34/608
2,688,806 A * 9/1954 Long ..... 34/75
2,695,103 A * 11/1954 Armstrong ..... 34/318

(Continued)

FOREIGN PATENT DOCUMENTS

JP 01022300 A * 1/1989

(Continued)

*Primary Examiner*—Stephen M. Gravini
(74) *Attorney, Agent, or Firm*—George L. Rideout, Esq.; Armstrong Teasdale LLP

(57) ABSTRACT

A plurality of dryer bumps for a dryer drum, wherein each bump includes a contact portion that is configured to be positioned within the drum proximate another bump contact portion, an outer portion that is configured to be positioned adjacent to the drum, and a body extending between the contact portion and the outer portion.

15 Claims, 4 Drawing Sheets

U.S. PATENT DOCUMENTS

| | | | | | |
|---|---|---|---|---|---|
| 2,701,421 | A | * | 2/1955 | Erickson et al. | 34/530 |
| 2,722,750 | A | * | 11/1955 | Smith et al. | 34/82 |
| 2,722,751 | A | * | 11/1955 | Steward | 34/82 |
| 2,737,729 | A | * | 3/1956 | Anthony | 34/602 |
| 2,748,496 | A | * | 6/1956 | Hellyer | 34/603 |
| 2,750,782 | A | * | 6/1956 | Hamell, Jr. | 68/140 |
| 2,751,688 | A | * | 6/1956 | Douglas | 34/82 |
| 2,783,549 | A | * | 3/1957 | Young | 34/83 |
| 2,787,841 | A | * | 4/1957 | Warino | 34/58 |
| 2,798,304 | A | * | 7/1957 | Reiter | 34/91 |
| 2,798,306 | A | * | 7/1957 | Reiter | 34/609 |
| 2,802,283 | A | * | 8/1957 | Strike | 34/87 |
| 2,813,414 | A | * | 11/1957 | Johnston | 68/20 |
| 2,814,130 | A | * | 11/1957 | Cayot | 34/82 |
| 2,851,791 | A | * | 9/1958 | Olthuis | 34/90 |
| 2,855,698 | A | * | 10/1958 | Hutt | 34/108 |
| 2,878,662 | A | * | 3/1959 | Brucken | 68/19.2 |
| 2,899,816 | A | * | 8/1959 | Jacobsen, Jr. | 68/20 |
| 2,921,384 | A | * | 1/1960 | Smith | 34/75 |
| 2,940,179 | A | * | 6/1960 | Czech | 34/77 |
| 2,960,780 | A | * | 11/1960 | Stilwell, Jr. | 38/2 |
| 2,967,417 | A | * | 1/1961 | Bochan | 68/23.5 |
| 2,974,422 | A | * | 3/1961 | Hobbs | 34/58 |
| 2,978,232 | A | * | 4/1961 | Kruzan | 366/232 |
| 2,985,967 | A | * | 5/1961 | Pataillot et al. | 34/608 |
| 2,991,990 | A | * | 7/1961 | Mitter | 432/107 |
| 2,996,809 | A | * | 8/1961 | Shapter | 34/75 |
| 3,000,108 | A | * | 9/1961 | Jones et al. | 34/607 |
| 3,023,514 | A | * | 3/1962 | Gibson | 34/589 |
| 3,027,653 | A | * | 4/1962 | Long et al. | 34/86 |
| 3,032,887 | A | * | 5/1962 | Whyte et al. | 34/524 |
| 3,034,221 | A | * | 5/1962 | Tuck et al. | 34/527 |
| 3,066,422 | A | * | 12/1962 | Douglas | 34/82 |
| 3,081,554 | A | * | 3/1963 | Long | 34/543 |
| 3,081,555 | A | * | 3/1963 | Stratman | 34/79 |
| 3,084,531 | A | * | 4/1963 | Matheny | 68/210 |
| 3,086,379 | A | * | 4/1963 | Plante | 68/12.13 |
| 3,089,327 | A | * | 5/1963 | Stilwell, Jr. | 68/139 |
| 3,094,860 | A | * | 6/1963 | Ferrah | 68/210 |
| 3,119,773 | A | * | 1/1964 | Compans | 210/144 |
| 3,139,633 | A | * | 7/1964 | Fecho et al. | 8/158 |
| 3,155,462 | A | * | 11/1964 | Erickson et al. | 34/82 |
| 3,219,479 | A | * | 11/1965 | Le Clercq | 428/87 |
| 3,221,524 | A | * | 12/1965 | Jacobs et al. | 68/12.08 |
| 3,237,317 | A | | 3/1966 | Huebsch, Sr. | |
| 3,261,389 | A | * | 7/1966 | Momchilovich et al. | 431/77 |
| 3,262,569 | A | * | 7/1966 | Wade et al. | 210/144 |
| 3,290,027 | A | * | 12/1966 | Alumbaugh | 432/41 |
| 3,296,711 | A | * | 1/1967 | Langford et al. | 34/109 |
| 3,304,624 | A | * | 2/1967 | Czech | 34/82 |
| 3,320,678 | A | * | 5/1967 | Berke | 34/82 |
| 3,333,346 | A | * | 8/1967 | Brucken | 34/131 |
| 3,334,496 | A | * | 8/1967 | Roeske | 68/23.7 |
| 3,357,109 | A | * | 12/1967 | Harvey | 34/91 |
| 3,358,302 | A | * | 12/1967 | Candor | 8/159 |
| 3,364,588 | A | * | 1/1968 | Ziegler | 34/573 |
| 3,391,471 | A | * | 7/1968 | Petterson | 34/134 |
| 3,402,576 | A | * | 9/1968 | Krupsky | 68/4 |
| 3,429,056 | A | * | 2/1969 | Metzger | 34/601 |
| 3,531,954 | A | * | 10/1970 | Krupsky | 68/18 F |
| 3,555,701 | A | * | 1/1971 | Hubbard | 34/602 |
| 3,584,393 | A | * | 6/1971 | Menk | 34/562 |
| 3,584,394 | A | * | 6/1971 | Grabek | 34/599 |
| 3,605,281 | A | * | 9/1971 | Hubbard | 34/599 |
| 3,616,545 | A | * | 11/1971 | Jacobs | 34/599 |
| 3,624,919 | A | * | 12/1971 | Miller | 34/607 |
| 3,643,349 | A | * | 2/1972 | Zenz | 34/595 |
| 3,678,714 | A | * | 7/1972 | Krolzick | 68/131 |
| 3,693,382 | A | * | 9/1972 | Grantham | 68/96 |
| 3,718,982 | A | * | 3/1973 | Deaton | 34/82 |
| 3,721,015 | A | * | 3/1973 | Sisler et al. | 34/601 |
| 3,722,106 | A | * | 3/1973 | Takeyama et al. | 34/82 |
| 3,729,834 | A | * | 5/1973 | Fox | 34/139 |
| 3,811,202 | A | * | 5/1974 | Arendt | 34/599 |
| 3,815,257 | A | * | 6/1974 | Freze | 34/129 |
| 3,815,258 | A | * | 6/1974 | Beard, Jr. | 34/602 |
| 3,840,998 | A | | 10/1974 | Marcussen | |
| 3,854,221 | A | * | 12/1974 | Grantham | 34/371 |
| 3,870,145 | A | * | 3/1975 | Mizuno | 206/0.5 |
| 3,875,681 | A | * | 4/1975 | De Pas | 34/75 |
| 3,915,596 | A | * | 10/1975 | Frazer | 417/423.1 |
| 3,916,232 | A | * | 10/1975 | Barone | 310/63 |
| 3,938,260 | A | | 2/1976 | Brenner et al. | |
| 3,967,008 | A | * | 6/1976 | Mizuno et al. | 427/242 |
| 3,969,070 | A | * | 7/1976 | Thompson | 432/105 |
| 4,004,685 | A | * | 1/1977 | Mizuno et al. | 206/0.5 |
| 4,015,930 | A | * | 4/1977 | Grantham | 432/105 |
| 4,041,614 | A | * | 8/1977 | Robinet | 34/92 |
| 4,069,596 | A | * | 1/1978 | Sisler | 34/242 |
| 4,098,937 | A | * | 7/1978 | Mizuno et al. | 428/68 |
| 4,105,813 | A | * | 8/1978 | Mizuno | 510/520 |
| 4,133,016 | A | * | 1/1979 | Tanguy | 361/23 |
| 4,137,197 | A | * | 1/1979 | Kowalchuk | 510/351 |
| 4,149,977 | A | * | 4/1979 | Morganson et al. | 510/519 |
| 4,162,994 | A | * | 7/1979 | Kowalchuk | 510/348 |
| 4,170,678 | A | * | 10/1979 | Urfer et al. | 428/124 |
| 4,279,764 | A | * | 7/1981 | Brubaker | 510/302 |
| 4,407,078 | A | * | 10/1983 | Takeyama et al. | 34/601 |
| 4,418,486 | A | * | 12/1983 | Kober | 38/58 |
| 4,452,054 | A | * | 6/1984 | Hafstrom | 68/133 |
| 4,489,574 | A | * | 12/1984 | Spendel | 68/16 |
| 4,507,080 | A | * | 3/1985 | Freze | 432/105 |
| 4,526,699 | A | * | 7/1985 | Jones et al. | 510/302 |
| 4,642,258 | A | * | 2/1987 | Majewski et al. | 428/68 |
| 4,677,760 | A | * | 7/1987 | St. Louis | 34/90 |
| 4,702,016 | A | * | 10/1987 | Grigsby et al. | 34/499 |
| 4,817,297 | A | * | 4/1989 | Toma et al. | 34/595 |
| 4,817,298 | A | * | 4/1989 | Toma | 34/595 |
| 4,875,298 | A | * | 10/1989 | Wright | 34/86 |
| 4,881,325 | A | | 11/1989 | Jordan et al. | |
| 4,920,662 | A | * | 5/1990 | Seeburger | 34/60 |
| 4,977,479 | A | * | 12/1990 | Caroll | 361/220 |
| 5,042,171 | A | * | 8/1991 | Obata et al. | 34/604 |
| 5,074,131 | A | * | 12/1991 | Hirose et al. | 68/19.2 |
| 5,075,613 | A | * | 12/1991 | Fisher | 318/809 |
| 5,107,606 | A | * | 4/1992 | Tsubaki et al. | 34/596 |
| 5,161,394 | A | * | 11/1992 | Felzer et al. | 68/23 R |
| 5,172,490 | A | * | 12/1992 | Tatsumi et al. | 34/488 |
| 5,200,684 | A | * | 4/1993 | Fisher | 318/809 |
| 5,212,969 | A | * | 5/1993 | Tsubaki et al. | 68/19.2 |
| 5,220,734 | A | * | 6/1993 | Carver | 34/600 |
| 5,220,813 | A | * | 6/1993 | Chen et al. | 68/3 SS |
| 5,257,468 | A | * | 11/1993 | Lebrun | 34/235 |
| 5,307,651 | A | * | 5/1994 | Felzer | 68/23.5 |
| 5,371,956 | A | * | 12/1994 | St. Louis | 34/599 |
| 5,416,983 | A | * | 5/1995 | Moser | 34/250 |
| 5,421,103 | A | * | 6/1995 | Wunderlich | 34/599 |
| 5,463,821 | A | * | 11/1995 | Gauer | 34/261 |
| 5,495,681 | A | * | 3/1996 | Paradis | 34/602 |
| 5,590,616 | A | * | 1/1997 | Vera | 114/61.16 |
| 5,657,526 | A | * | 8/1997 | Yatcko | 29/416 |
| 5,661,914 | A | * | 9/1997 | Millet | 34/601 |
| 5,706,588 | A | * | 1/1998 | Dausch et al. | 34/327 |
| 5,724,750 | A | * | 3/1998 | Burress | 34/267 |
| 5,746,070 | A | * | 5/1998 | Bailey et al. | 68/24 |
| 5,806,204 | A | * | 9/1998 | Hoffman et al. | 34/92 |
| 5,865,851 | A | * | 2/1999 | Sidoti et al. | 8/142 |
| 5,901,465 | A | * | 5/1999 | Boussetta et al. | 34/602 |
| 5,908,473 | A | * | 6/1999 | Weller et al. | 8/142 |
| 6,088,932 | A | | 7/2000 | Adamski et al. | |
| 6,151,795 | A | * | 11/2000 | Hoffman et al. | 34/92 |
| 6,200,949 | B1 | * | 3/2001 | Reijmer et al. | 510/443 |
| 6,324,771 | B1 | | 12/2001 | McAllister et al. | |
| 6,343,492 | B1 | * | 2/2002 | Seagar et al. | 68/142 |

6,363,756 B1 * 4/2002 Seagar et al. ..... 68/210
6,370,798 B1 * 4/2002 Gonzalez, Sr. ..... 34/595
6,401,362 B1 * 6/2002 Schultz et al. ..... 34/499
6,401,363 B1 * 6/2002 Miramondi ..... 34/602
6,477,867 B1 * 11/2002 Collecutt et al. ..... 68/12.06
6,481,035 B2 * 11/2002 Seagar et al. ..... 8/159
6,562,770 B2 * 5/2003 Pashkovski et al. ..... 510/101
6,578,391 B2 * 6/2003 Seagar et al. ..... 68/142
6,637,127 B2 * 10/2003 Reede et al. ..... 34/527
6,698,107 B2 * 3/2004 Song et al. ..... 34/595
6,715,175 B2 * 4/2004 Ciancimino et al. ..... 8/159
6,740,631 B2 * 5/2004 Shefer et al. ..... 510/441
6,745,495 B1 * 6/2004 Riddle et al. ..... 34/497
6,751,888 B2 * 6/2004 Lueckenbach ..... 34/595
6,757,986 B2 * 7/2004 Miller et al. ..... 34/132
6,769,196 B2 * 8/2004 Park et al. ..... 34/77
6,862,903 B2 * 3/2005 Nitschmann et al. ..... 68/5 E
6,874,248 B2 * 4/2005 Hong et al. ..... 34/239
6,892,408 B2 * 5/2005 Goddard et al. ..... 8/158
6,908,962 B1 * 6/2005 Frankenbach et al. ..... 524/588
6,918,194 B2 * 7/2005 Freese et al. ..... 34/604
6,922,912 B2 * 8/2005 Phillips ..... 34/403
6,941,678 B2 * 9/2005 Park ..... 34/528
6,954,992 B2 * 10/2005 Hwang ..... 34/108
6,954,995 B2 * 10/2005 Kitamura et al. ..... 34/597
6,957,501 B2 * 10/2005 Park et al. ..... 34/446
6,966,124 B2 * 11/2005 Ryu ..... 34/134
6,968,632 B2 * 11/2005 Guinibert et al. ..... 34/602
6,995,965 B2 * 2/2006 Hameed et al. ..... 361/91.1
6,996,920 B2 * 2/2006 Bang et al. ..... 34/494
7,010,942 B2 * 3/2006 Ryu et al. ..... 68/19
7,017,282 B2 * 3/2006 Pyo et al. ..... 34/596
7,024,795 B2 * 4/2006 Tadano et al. ..... 34/76
7,036,243 B2 * 5/2006 Doh et al. ..... 34/595
7,055,262 B2 * 6/2006 Goldberg et al. ..... 34/86
7,065,904 B2 * 6/2006 Lee et al. ..... 34/601
7,065,905 B2 * 6/2006 Guinibert et al. ..... 34/603
7,074,919 B2 * 7/2006 Aubay et al. ..... 536/114
7,093,377 B2 * 8/2006 Doh et al. ..... 34/596
7,096,695 B2 * 8/2006 No et al. ..... 68/58
7,117,613 B2 * 10/2006 Guinibert et al. ..... 34/534
7,121,018 B2 * 10/2006 Lee ..... 34/595
7,140,123 B2 * 11/2006 Lee ..... 34/601
7,168,273 B2 * 1/2007 Neergaard et al. ..... 68/17 R
7,178,265 B2 * 2/2007 Ford ..... 34/601
7,194,824 B2 * 3/2007 Wang ..... 34/602
7,207,124 B2 * 4/2007 Kim ..... 34/601
7,225,562 B2 * 6/2007 Guinibert et al. ..... 34/601
7,228,647 B2 * 6/2007 Hong ..... 34/596
7,249,742 B2 * 7/2007 Guinibert et al. ..... 248/188.3
7,251,905 B2 * 8/2007 Doh et al. ..... 34/603
7,257,905 B2 * 8/2007 Guinibert et al. ..... 34/82
7,305,775 B2 * 12/2007 Favret et al. ..... 34/82
7,322,126 B2 * 1/2008 Beaulac ..... 34/554
7,322,127 B2 * 1/2008 Hwang ..... 34/603
7,325,330 B2 * 2/2008 Kim et al. ..... 34/407
7,340,847 B2 * 3/2008 Kim ..... 34/601
7,340,848 B2 * 3/2008 Ford ..... 34/601
7,340,849 B2 * 3/2008 Kim ..... 34/602
7,395,612 B2 * 7/2008 Jeong et al. ..... 34/602
7,406,780 B2 * 8/2008 Doh et al. ..... 34/606
7,412,783 B2 * 8/2008 Guinibert et al. ..... 34/572
7,467,483 B2 * 12/2008 Guinibert et al. ..... 34/601
7,523,564 B2 * 4/2009 Doh ..... 34/601
2002/0014095 A1 * 2/2002 Seagar et al. ..... 68/142
2002/0035757 A1 * 3/2002 Ciancimino et al. ..... 8/159
2002/0040506 A1 * 4/2002 Seagar et al. ..... 8/159
2003/0000105 A1 * 1/2003 Song et al. ..... 34/595
2003/0032564 A1 * 2/2003 Pashkovski et al. ..... 510/101
2003/0061728 A1 * 4/2003 Reede et al. ..... 34/526
2003/0061843 A1 * 4/2003 Ryu et al. ..... 68/17 R
2003/0074932 A1 * 4/2003 No et al. ..... 68/58
2003/0115768 A1 * 6/2003 Hoffman ..... 34/92
2003/0203829 A1 * 10/2003 Shefer et al. ..... 510/327
2004/0019977 A1 * 2/2004 Goddard et al. ..... 8/159
2004/0060196 A1 * 4/2004 Lueckenbach ..... 34/595
2004/0067864 A1 * 4/2004 Aubay et al. ..... 510/405
2004/0068889 A1 * 4/2004 Park et al. ..... 34/446
2004/0088796 A1 * 5/2004 Neergaard et al. ..... 8/158
2004/0098878 A1 * 5/2004 Park et al. ..... 34/595
2004/0103556 A1 * 6/2004 Bang ..... 34/595
2004/0107598 A1 * 6/2004 Hwang ..... 34/601
2004/0111916 A1 * 6/2004 Hwang ..... 34/601
2004/0123486 A1 * 7/2004 Hameed et al. ..... 34/595
2004/0123487 A1 * 7/2004 Han ..... 34/595
2004/0123488 A1 * 7/2004 Han ..... 34/595
2004/0134092 A1 * 7/2004 Hong et al. ..... 34/595
2004/0134093 A1 * 7/2004 Han ..... 34/595
2004/0143987 A1 * 7/2004 Phillips ..... 34/218
2004/0168343 A1 * 9/2004 Park ..... 34/606
2004/0168344 A1 * 9/2004 Park ..... 34/606
2004/0172985 A1 * 9/2004 Mamiya et al. ..... 68/12.05
2004/0200093 A1 * 10/2004 Wunderlin et al. ..... 34/606
2004/0216326 A1 * 11/2004 Kitamura et al. ..... 34/597
2004/0221477 A1 * 11/2004 Han et al. ..... 34/601
2004/0261288 A1 * 12/2004 Beyerle et al. ..... 34/602
2004/0263032 A1 * 12/2004 Cho ..... 312/330.1
2005/0044744 A1 * 3/2005 Tadano et al. ..... 34/596
2005/0050766 A1 * 3/2005 Freese et al. ..... 34/604
2005/0066538 A1 * 3/2005 Goldberg et al. ..... 34/218
2005/0076455 A1 * 4/2005 Guinibert et al. ..... 8/158
2005/0076535 A1 * 4/2005 Guinibert et al. ..... 34/601
2005/0082446 A1 * 4/2005 Guinibert et al. ..... 248/188.3
2005/0097772 A1 * 5/2005 Lee ..... 34/601
2005/0102853 A1 * 5/2005 Wang ..... 34/602
2005/0115104 A1 * 6/2005 Guinibert et al. ..... 34/601
2005/0120585 A1 * 6/2005 Lee et al. ..... 34/602
2005/0120586 A1 * 6/2005 Hwang et al. ..... 34/603
2005/0125910 A1 * 6/2005 Guinibert et al. ..... 8/158
2005/0126034 A1 * 6/2005 Jeong et al. ..... 34/602
2005/0126035 A1 * 6/2005 Lee et al. ..... 34/602
2005/0132593 A1 * 6/2005 Doh et al. ..... 34/73
2005/0132594 A1 * 6/2005 Doh et al. ..... 34/73
2005/0132601 A1 * 6/2005 Doh ..... 34/601
2005/0132602 A1 * 6/2005 Jeong et al. ..... 34/602
2005/0132604 A1 * 6/2005 Hong et al. ..... 34/603
2005/0132759 A1 * 6/2005 Guinibert et al. ..... 68/24
2005/0138831 A1 * 6/2005 Lee ..... 34/73
2005/0155250 A1 * 7/2005 Chung et al. ..... 34/602
2005/0155251 A1 * 7/2005 Lee ..... 34/604
2005/0166421 A1 * 8/2005 Doh et al. ..... 34/603
2005/0183284 A1 * 8/2005 Hwang et al. ..... 34/603
2005/0235519 A1 * 10/2005 Chung ..... 34/607
2005/0252022 A1 * 11/2005 Tyau ..... 34/82
2006/0096114 A1 * 5/2006 Hong ..... 34/77
2006/0107548 A1 * 5/2006 Ford ..... 34/601
2006/0112590 A1 * 6/2006 Kim ..... 34/603
2006/0117596 A1 * 6/2006 Kim et al. ..... 34/607
2006/0130358 A1 * 6/2006 Kim ..... 34/494
2006/0150439 A1 * 7/2006 Latack et al. ..... 34/601
2006/0174511 A1 * 8/2006 Lee et al. ..... 34/605
2006/0179676 A1 * 8/2006 Goldberg et al. ..... 34/77
2006/0196077 A1 * 9/2006 Choi ..... 34/602
2006/0201014 A1 * 9/2006 Favret et al. ..... 34/82
2006/0236560 A1 * 10/2006 Doh et al. ..... 34/596
2006/0247145 A1 * 11/2006 Guinibert et al. ..... 510/294
2006/0254083 A1 * 11/2006 Ford ..... 34/601
2006/0254084 A1 * 11/2006 Ford ..... 34/601
2006/0260150 A1 * 11/2006 Doh ..... 34/601
2006/0265899 A1 * 11/2006 Renzo ..... 34/603
2007/0006477 A1 * 1/2007 Guinibert et al. ..... 34/85
2007/0006485 A1 * 1/2007 Kim ..... 34/603
2007/0062513 A1 * 3/2007 Gagas ..... 126/299 D
2007/0101772 A1 * 5/2007 Duncan et al. ..... 68/3 R
2007/0113419 A1 * 5/2007 Belgard ..... 34/82
2007/0186440 A1 * 8/2007 Guinibert et al. ..... 34/603

2007/0220776 A1* 9/2007 Guinibert et al. ..... 34/603
2007/0227031 A1* 10/2007 Yoon ..... 34/242
2007/0256322 A1* 11/2007 Kim et al. ..... 34/603
2008/0022551 A1* 1/2008 Banta et al. ..... 34/602
2008/0022552 A1* 1/2008 Forget ..... 34/602
2008/0060218 A1* 3/2008 Doh ..... 34/601
2008/0141558 A1* 6/2008 Bae et al. ..... 34/595
2008/0196268 A1* 8/2008 Jung et al. ..... 34/603
2008/0203872 A1* 8/2008 Cho ..... 312/330.1
2008/0217324 A1* 9/2008 Abbott ..... 219/538
2009/0056161 A1* 3/2009 Ahn et al. ..... 34/79
2009/0064534 A1* 3/2009 LeClerc ..... 34/603
2009/0071029 A1* 3/2009 Favret et al. ..... 34/130
2009/0071033 A1* 3/2009 Ahn et al. ..... 34/595
2009/0083991 A1* 4/2009 Prajescu ..... 34/601
2009/0083992 A1* 4/2009 Prajescu et al. ..... 34/601
2009/0139108 A1* 6/2009 Ricklefs et al. ..... 34/130
2009/0167129 A1* 7/2009 Cho ..... 312/348.4

FOREIGN PATENT DOCUMENTS

JP 01027599 A * 1/1989
JP 01178299 A * 7/1989
JP 01285299 A * 11/1989
JP 04240494 A * 8/1992
JP 05220298 A * 8/1993
JP 05245294 A * 9/1993
JP 06190192 A * 7/1994
JP 07275584 A * 10/1995
JP 07275585 A * 10/1995
JP 07275586 A * 10/1995
JP 08024494 A * 1/1996
JP 08024497 A * 1/1996
JP 08332300 A * 12/1996
JP 11179100 A * 7/1999

* cited by examiner

CLOTHES DRYER DRUM PROJECTIONS

BACKGROUND OF THE INVENTION

This invention relates generally to clothes drying systems, and, more particularly, to tumbling aids for clothes dryers.

An appliance for drying articles such as a clothes dryer for drying clothing articles typically includes an exterior cabinet and internal rotating drum for tumbling clothes and laundry articles therein. One or more heating elements heats air prior to air entering the drum, and the warm air is circulated through the dryer as the clothes are tumbled to remove moisture from the laundry articles contained in the drum.

Some known clothes dryers utilize an extended surface on the interior of the drum, called a baffle to facilitate the tumbling of the clothes. Typically the baffles are mounted on the inside surface of the drying drum to lift the clothes into the warm air stream and to tumble the clothes towards the approximate rotational center of the drum. The shapes and sizes of baffles vary greatly but in general have uniform height that extends across the depth of the cylindrical drum. Other known baffles have varying heights across the depth of the drum and may be curved to better lift the clothes to as they tumble within the drum.

Known baffle designs may reduce the usable capacity in the drum, which, in turn, may increase the number of loads of laundry required by the operator and may restrict the air flow within the drum increasing the time to dry the clothes contained within the drum. Increasing the usable capacity of the dryer drum allows the operator to add additional laundry, reduce the number of drying operations, dry the clothes faster, and conserve energy.

BRIEF DESCRIPTION OF THE INVENTION

In one aspect, plurality of dryer bumps are provided that include a contact portion that is configured to be positioned within the drum proximate another bump contact portion, an outer portion that is configured to be positioned adjacent to the drum, and a body extending between the contact portion and the outer portion.

In another aspect, a dryer drum for a clothes dryer is provided that includes a perforated back wall and a cylindrical outer wall adjacent to the back wall, wherein the outer wall includes an inner surface, an exterior surface, and a body extending therebetween and at least one dryer bump attached to the outer wall.

In another aspect, a clothes dryer is provided that includes a cabinet, a rotatable drum mounted in the cabinet, wherein the drum is configured to secure at least one laundry article against an inner surface of the drum during dryer operation, the drum is further configured to allow substantially unobstructed access to the drum. The dryer further includes at least one dryer bump protruding in to the drum, a motor for rotating the drum, an air circulation system, a heater for warming air circulated by the air circulation system, and a controller that is operatively coupled to the motor, the air circulation system temperature, and the heater.

DETAILED DESCRIPTION OF THE INVENTION

Figure 1:
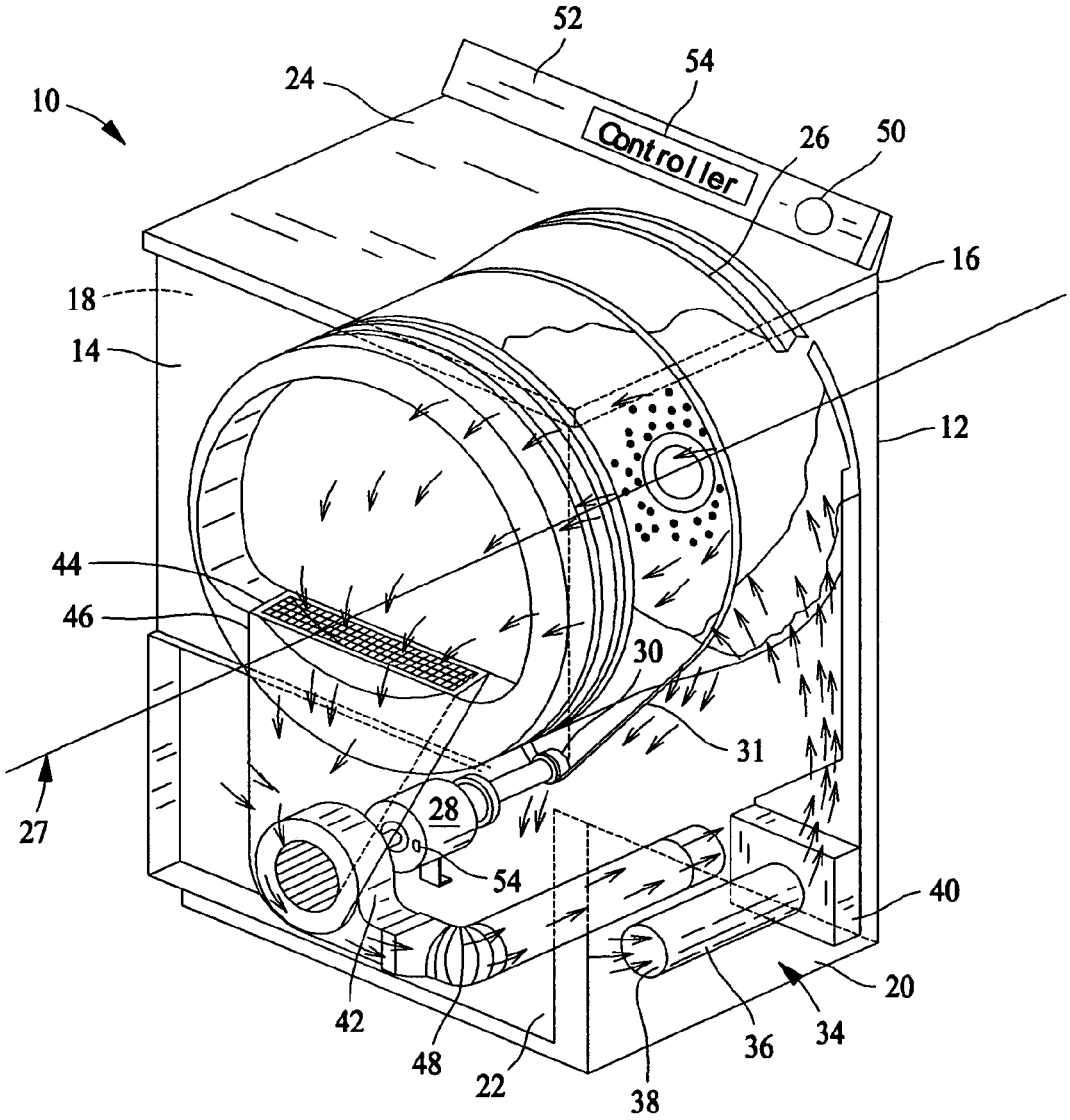
FIG. 1 is partial perspective view of an exemplary dryer appliance.

FIG. 1 is an exemplary clothes dryer appliance 10 in which the present invention may be practiced. While described in the context of a specific embodiment of dryer 10, it is recognized that the benefits of the invention may accrue to other types and embodiments of dryer appliances. Therefore, the following description is set forth for illustrative purposes only, and the invention is not intended to be limited in practice to a specific embodiment of dryer appliance, such as dryer 10.

Clothes dryer 10 includes a cabinet or a main housing 12 having a front panel 14, a rear panel 16, a pair of side panels 18 and 20 spaced apart from each other by the front and rear panels, a bottom panel 22, and a top cover 24. Within cabinet 12 is a drum or container 26, described in greater detail below, mounted for rotation around a substantially horizontal axis 27. A motor 28 rotates drum 26 about horizontal axis 27 through a pulley 30 and a belt 31. Drum 26 is supported within main housing 12 by a suitable fixed bearing (not shown) and is configured to receive hot air that has been heated by a heater 34 such as a combustion chamber 36 and a rear duct 38. The combustion chamber 36 receives ambient air via an inlet 40.

Although the clothes dryer 10 is illustrated in FIG. 1 as a gas dryer, in one embodiment dryer 10 is an electric dryer without combustion chamber 36 and rear duct 38. The heated air is drawn from drum 26 by a blower fan 42 which is also driven by motor 28. The air passes through a screen filter 44 which traps any lint particles. As the air passes through screen filter 44, the air enters a trap duct seal 46 and is passed out of clothes dryer 10 through an exhaust duct 48. A cycle selector knob 50 is mounted on a cabinet backsplash 52 and is in communication with a controller 54. Signals generated in controller 54 operate motor 28 and heater 34 in response to a position of selector knob 50.

Figure 2:
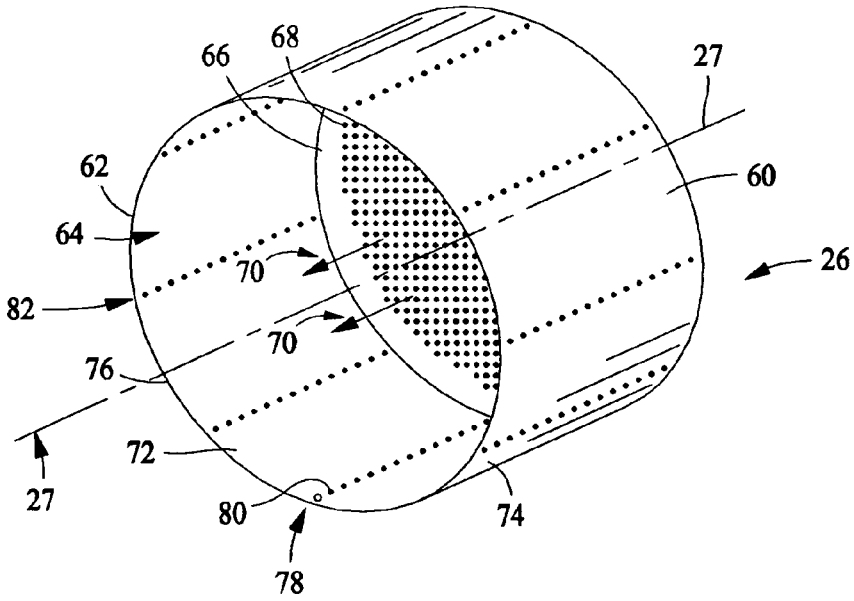
FIG. 2 is perspective view of an exemplary dryer drum shown in FIG. 1.

FIG. 2 is perspective view of dryer drum 26 (shown in FIG. 1). Drum 26 is generally cylindrical in shape, having an outer cylindrical wall 60 and a front flange or wall 62 defining an opening 64 therein to accommodate loading and unloading drum 26 with articles of clothing. In one embodiment, outer wall 60 is attached to a rear wall 66 that includes a plurality of holes 68 for receiving hot air 70 from heater 34 (shown in FIG. 1). In an alternative embodiment, outer wall 60 is not attached to rear wall 66 and rotates independently of rear wall 66.

Outer wall 60 has an inner surface 72, an outer surface 74, and a body 76 that extends therebetween. In one embodiment, a plurality of apertures 78, described in greater detail below, are disposed in outer wall 60 wherein each aperture 78 is configured to receive a dryer bump 80, described in greater detail below, therein. Each aperture 78 is equally spaced, and arranged in a plurality of rows 82. Each row 82 is parallel to the horizontal axis 27 and equally spaced circumferentially about outer wall 60.

The illustrative embodiment includes eight rows 82 as it is a relatively large capacity dryer. Smaller dryers may include less than eight rows 82. It is anticipated that any plurality of rows 82 may be employed in dryer 10. For example, in illustrative embodiments, three, six, or nine rows 82 are employed in a drum, although even greater numbers of rows 82 may be employed. As such, the embodiments shown in FIGS. 1 and 2 are provided for illustrative purposes only, and in no way is intended to be restricted to practice in any particular number of rows or in any particular location in a dryer.

Figure 3:
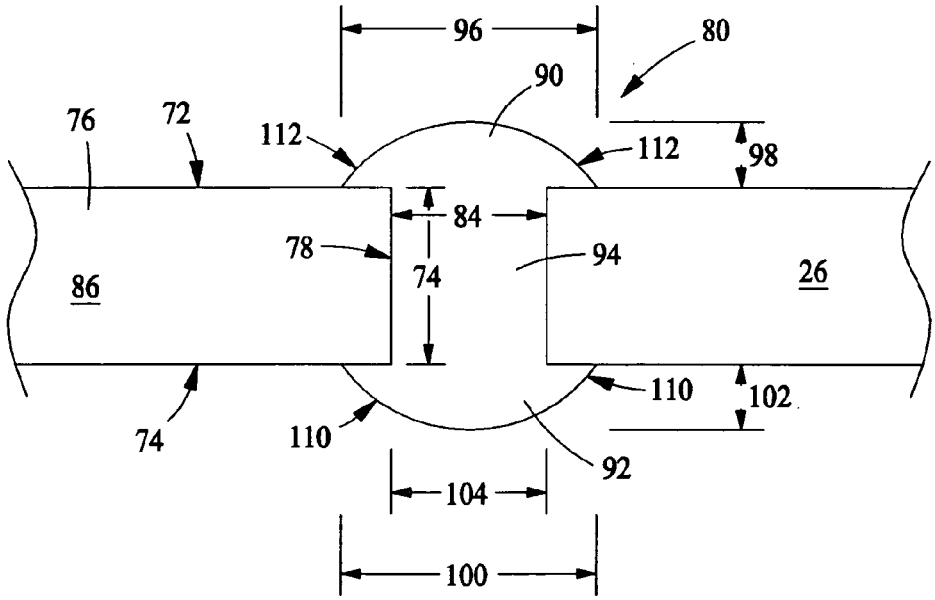
FIG. 3 is a partial side view of the dryer drum shown in FIG. 2.

FIG. 3 is a partial side view of dryer drum aperture 78 and dryer bump 80. Each aperture 78 has a diameter 84 variably sized to accommodate each dryer bump 80. In one embodiment, diameter 84 is 0.40 inches. In another embodiment, diameter 84 is approximately between 0.30 inches and 0.50 inches. In yet another embodiment, diameter 84 is approximately between 0.20 inches and 0.60 inches.

Each dryer bump 80 includes a contact portion 90, an attachment portion 92, and a body 94 that extends therebetween. Contact portion 90 includes a diameter 96 variably sized to drum 26 and a height 98 measured from drum inner surface 72. Contact portion diameter 96 is greater than aperture diameter 84. In one embodiment, diameter 96 is 0.45 inches and height 98 is 0.23 inches. In another embodiment, diameter 96 is approximately between 0.40 inches and 0.50 inches and height 98 is approximately between 0.18 inches and 0.28 inches. In yet another embodiment, diameter 96 is approximately between 0.25 inches and 0.65 inches and height 98 is approximately between 0.10 inches and 0.50 inches.

Contact portion 90 may have a variety of shapes that facilitate securing clothing articles against drum interior surface 72. In the exemplary embodiment, contact portion 90 is hemispherical-shaped. In another embodiment, contact portion 90 is convex-shaped. In an alternate embodiment, contact portion 90 is cylindrical-shaped.

Attachment portion 92 includes a diameter 100 variably sized to aperture 78 and a height 102 measured from drum exterior surface 74. Attachment portion diameter 100 is greater than aperture diameter 84. In one embodiment, diameter 100 is 0.45 inches and height 102 is 0.23 inches. In another embodiment, diameter 100 is approximately between 0.40 inches and 0.50 inches and height 102 is approximately between 0.18 inches and 0.28 inches. In yet another embodiment, diameter 100 is approximately between 0.25 inches and 0.65 inches and height 102 is approximately between 0.10 inches and 0.50 inches.

Attachment portion 92 may have a variety of shapes that facilitate securing bump 80 against drum interior surface 72. In the exemplary embodiment, attachment portion 92 is hemispherical-shaped. In another embodiment, contact portion 90 is conical-shaped.

Body 94 includes a diameter 104 and a height 106 measured from contact portion 90 to attachment portion 92. In one embodiment, body diameter 104 is substantially equal to aperture diameter 84. In one embodiment, diameter 104 is 0.40 inches and height 106 is 0.018 inches. In another embodiment, diameter 104 is approximately between 0.30 inches and 0.50 inches and height 106 is approximately between 0.017 inches and 0.019 inches. In yet another embodiment, diameter 104 is approximately between 0.20 inches and 0.60 inches and height 106 is approximately between 0.015 inches and 0.021 inches.

In one embodiment, bump 80 is manufactured from an elastomer such as vulcanized rubber, silicone rubber, and natural rubber. In an alternative embodiment, bump 80 is manufactured from a high-impact, heat-resistant, and resilient material. In one embodiment, bump 80 is unitary and solid. In an alternative embodiment, bump 80 is non-unitary and hollow.

Bumps 80 may be secured to drum 26 by hand, by machine, or by any means appropriate. In one embodiment, attachment portion 92 includes an attachment lip 110 that extends about the circumference of portion 92. Lip 110 is configured to pass through aperture 78 and seat adjacent drum outer surface 74. Contact portion 90 includes an attachment lip 112 that extends about the circumference of portion 90. Lip 112 is configured to seat adjacent drum inner surface 72 after lip 110 is seated. Body 94 is configured to seat adjacent drum aperture 78 and create an air tight seal such that bumps 80 facilitate preventing air passage in or out of drum 26.

Figure 4:
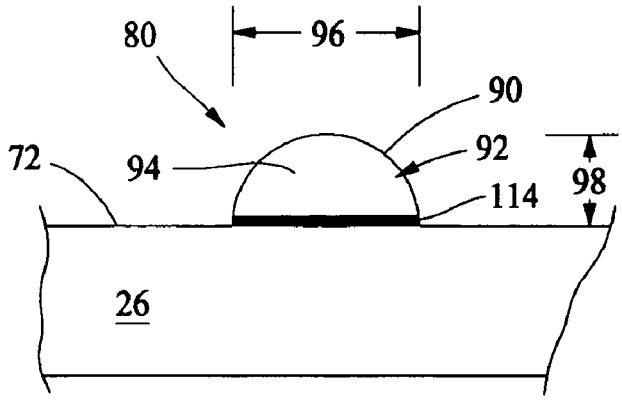
FIG. 4 is a perspective view of an alternative embodiment of the dryer drum bump shown in FIG. 3.

FIG. 4 is a partial side view of an alternative embodiment of dryer bump 80 shown in FIG. 3. Attachment portion 92 is configured to be coupled to drum inner surface 72 using a chemical fastener 114, including, but not limited to, an adhesive or a glue. In one embodiment, attachment portion 92 is substantially flat.

Figure 5:
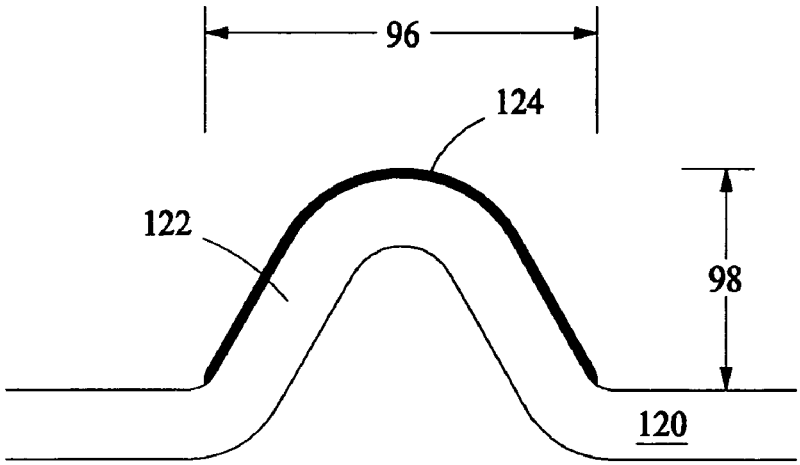
FIG. 5 is a partial side view of another alternative embodiment of dryer drum and dryer bumps shown in FIG. 3.

FIG. 5 is a perspective view of an alternative embodiment of dryer drum 26 and dryer bumps 80 shown in FIG. 3. A drum 120 is cast such that a plurality of bumps 122 are stamped into rows as described above. Bumps 122 are coated with rubber or a rubber-like material 124. Bumps 122 are shaped and sized similar to bumps 80. Rubber material 124 is fabricated from a rubber material similar to bump 80.

Figure 6:
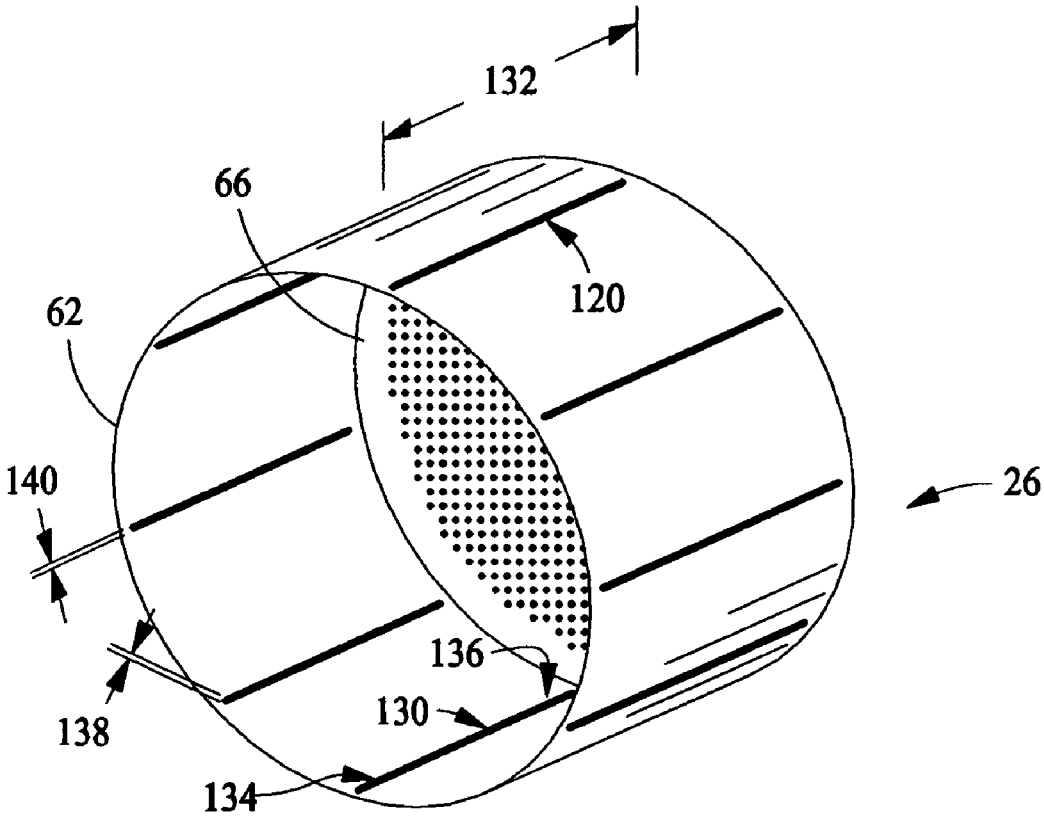
FIG. 6 is a perspective view of another alternative embodiment of the dryer drum bump shown in FIG. 3.

FIG. 6 is a perspective view of an alternative embodiment of dryer bump 80 shown in FIG. 3. A plurality of bumps 130 have a length 132 measured from a front end 134 to a back end 136, a height 138 measured from contact portion 90 to attachment portion 92, and a diameter 140. Bumps 130 extend substantially the entire length of drum 26 from front wall 62 to rear wall 66. Bumps 130 may be attached using one of the methods described above. Bumps 130 are shaped and sized similar to bumps 80. Bumps 130 are fabricated from a material similar to bumps 80.

The above-described clothes dryer is cost effective and energy efficient. The dryer includes a drum that includes a plurality of dryer bumps. Each bump is small and includes a contact portion that facilitates tumbling clothing articles, thus eliminating the need for baffles, and increasing the usable capacity of the dryer during dryer operations. As a result of the increased usable capacity, the operator may add additional laundry. Thus a dryer is provided which reduces the number of drying operations and conserves energy.

Exemplary embodiments of dryer drums and dryer bumps are described above in detail. The drums and bumps are not limited to the specific embodiments described herein, but rather, components of each may be utilized independently and separately from other components described herein. Each drum and bump component can also be used in combination with other dryer components.

While the invention has been described in terms of various specific embodiments, those skilled in the art will recognize that the invention can be practiced with modification within the spirit and scope of the claims.

What is claimed is:

1. A plurality of dryer bumps for a substantially cylindrical dryer drum of a clothes dryer, the dryer drum comprising an outer wall defining a radially outer surface, a radially inner surface, and a plurality of apertures extending through the outer wall between the radially outer surface and the radially inner surface, each said dryer bump comprising:

a unitary member coupled to the dryer drum of the clothes dryer, said unitary member comprising:

a hemispherical contact portion contacting the inner surface of the dryer drum and extending into a drum cavity and proximate another dryer bump of said plurality of dryer bumps;

a hemispherical attachment portion contacting the outer surface and extending radially outward from the outer surface; and a cylindrical solid body positioned within a corresponding aperture of the plurality of apertures and extending through the outer wall, said solid body coupling said contact portion to said attachment portion to form said unitary member.

2. A plurality of dryer bumps in accordance with claim 1 wherein said contact portion is configured to secure at least one laundry article against the drum inner surface and allow substantially unobstructed access to the drum.

3. A plurality of dryer bumps in accordance with claim 1 wherein said attachment portion is configured to secure said dryer bump to the drum.

4. A plurality of dryer bumps in accordance with claim 1 wherein said dryer bump comprises an elastomer.

5. A plurality of dryer bumps in accordance with claim 1 wherein said dryer bump is solid.

6. A dryer drum for a clothes dryer, said dryer drum comprising:

a perforated back wall; and a cylindrical outer wall adjacent to said back wall, said outer wall comprising:

a radially inner surface, a radially outer surface, an outer wall body extending therebetween, and a plurality of apertures extending through the outer wall body between said inner surface and said outer surface; and a plurality of unitary and solid dryer bumps coupled with said outer wall, each of said plurality of dryer bumps comprising:

a hemispherical elastomer contact portion configured to directly contact clothes placed within said dryer drum;

a hemispherical outer portion; and a cylindrical bump body positioned within a corresponding aperture of said plurality of apertures and extending through said outer wall body, said solid body coupling said contact portion to said attachment portion to form said unitary and solid dryer bump, said contact portion contacting said inner surface and extending into a drum cavity, said outer portion contacting said outer surface and extending radially outward from said outer surface, and said plurality of dryer bumps are arranged in a plurality of rows that are parallel to a rotational axis of said dryer drum, each of said plurality of rows including at least two said dryer bumps.

7. A dryer drum in accordance with claim 6 wherein said outer wall body includes a plurality of circumferentially spaced apertures extending therethrough.

8. A dryer drum in accordance with claim 7 wherein each said aperture is equally spaced and arranged in said rows, wherein each said row is parallel to the rotational axis of said drum and equally spaced circumferentially about said drum.

9. A dryer drum in accordance with claim 7 wherein each said aperture has a diameter that is sized to receive said at least one dryer bump at least partially therein, said outer portion configured to be inserted through said aperture such that said bump body engages said diameter.

10. A dryer drum in accordance with claim 9 wherein each said dryer bump contact portion extends inward a distance and is configured to secure at least one clothing article against said dryer drum outer wall.

11. A clothes dryer comprising:

a cabinet;

a rotatable drum mounted in said cabinet, wherein said drum comprises a front wall, a back wall, and an outer wall extending therebetween, said outer wall having a radially outer surface, a radially inner surface, and defining a plurality of apertures extending through said outer wall between said outer surface and said inner surface, said drum configured to releasably retain at least one laundry article against the inner surface during dryer operation, said drum further configured to allow substantially unobstructed access to said drum; and a plurality of unitary dryer bumps coupled to said drum of said clothes dryer, said plurality of unitary dryer bumps arranged in a plurality of rows that are parallel to a rotational axis of said drum, each row of said plurality of rows including at least two unitary dryer bumps of said plurality of unitary dryer bumps, each unitary dryer bump of said plurality of unitary dryer bumps comprising:

a hemispherical contact portion;

a hemispherical attachment portion; and a cylindrical solid body positioned within a respective aperture of said plurality of apertures and extending through said outer wall, said solid body coupling said contact portion to said attachment portion to form said unitary dryer bump, each said unitary dryer bump configured to extend through said respective aperture such that no air passes through said respective aperture, said contact portion contacting said inner surface and extending into a cavity defined in said drum, said contact portion configured to directly contact the at least one laundry article, and said attachment portion contacting said outer surface and extending radially outward from said outer surface.

12. A clothes dryer in accordance with claim 11 wherein said drum is rotatable about a horizontal axis.

13. A clothes dryer in accordance with claim 11 wherein said drum outer wall is cylindrical and said plurality of apertures are arranged in rows parallel to the horizontal axis of said drum.

14. A clothes dryer in accordance with claim 11 wherein an aperture diameter is sized to receive said solid body therethrough such that said solid body circumferentially engages said aperture diameter.

15. A clothes dryer in accordance with claim 11 wherein each said dryer bump comprises an elastomer.

* * * * *